US008712611B2

(12) United States Patent
Denis et al.

(10) Patent No.: US 8,712,611 B2
(45) Date of Patent: Apr. 29, 2014

(54) COMPUTERIZED ON-BOARD SYSTEM FOR CONTROLLING A TRAIN

(75) Inventors: Philippe Denis, Tarciennes (BE); Pascal Vivegnis, Saint Symphorien (BE)

(73) Assignee: Alstom Transport SA, Levallois-Perret (FR)

( * ) Notice: Subject to any disclaimer, the term of this patent is extended or adjusted under 35 U.S.C. 154(b) by 851 days.

(21) Appl. No.: 12/483,023

(22) Filed: Jun. 11, 2009

(65) Prior Publication Data

US 2010/0004805 A1 Jan. 7, 2010

(30) Foreign Application Priority Data

Jun. 12, 2008 (FR) ..... 08 53909

(51) Int. Cl.
*G05D 1/00* (2006.01)
*B61L 15/00* (2006.01)

(52) U.S. Cl.
CPC ..... *B61L 15/0036* (2013.01); *B61L 15/0072* (2013.01)
USPC ..... 701/19; 701/20

(58) Field of Classification Search
CPC ..... B61L 15/0036; B61L 15/0072
USPC ..... 701/19, 20; 348/148, 159
See application file for complete search history.

(56) References Cited

U.S. PATENT DOCUMENTS 5,533,695 A * 7/1996 Heggestad et al. ..... 246/62
5,978,718 A * 11/1999 Kull ..... 701/19
6,163,755 A * 12/2000 Peer et al. ..... 701/301
6,587,764 B2 * 7/2003 Nickles et al. ..... 701/19
6,671,591 B2 * 12/2003 Wolf et al. ..... 701/19
7,079,926 B2 * 7/2006 Kane et al. ..... 701/19
2004/0245410 A1 * 12/2004 Kisak et al. ..... 246/3
2007/0040661 A1 * 2/2007 Takemura et al. ..... 340/461
2008/0186379 A1 * 8/2008 Ishigame et al. ..... 348/116

FOREIGN PATENT DOCUMENTS

DE 202007008825 10/2007
EP 1 065 127 1/2001
WO WO 2005/067142 7/2005
WO WO 2006/075767 7/2006

OTHER PUBLICATIONS

Kirrman et al. "The IEC/IEEE Train Communication Network" 2001, XP-002471919, pp. 81-92.*

(Continued)

*Primary Examiner* — Marthe Marc-Coleman
(74) *Attorney, Agent, or Firm* — Davidson, Davidson & Kappel, LLC

(57) ABSTRACT

A computerized on-board system for controlling a train or rail vehicle is provided. The computerized on-board system includes a train control and monitoring system (TCMS) having a main processor unit (MPU) for controlling the train and electronic control, command and monitoring equipment for providing control data for the train. The computerized on-board system also includes at least one display unit for making the control data of the train provided by the main processor unit (MPU) or by the electronic equipment available and a main data transfer network. The electronic equipment includes at least one additional item of equipment, the at least one additional item of equipment being electronic equipment for automatic train control (ATC) or video surveillance equipment (CCTV). The display unit processes the data and displays data produced by one of the at least one additional items of equipment.

16 Claims, 10 Drawing Sheets

(56) References Cited

OTHER PUBLICATIONS

Schultes, "The bus systems of the InterCityExpress", ZEV + DET. Glas. Ann. 116, vol. 116, Nov./Dec. 1992, pp. 438-442 (see English Abstract) (XP000332327).

Scintele, "Digital convergence in trainborne information systems", Signal + Draht, vol. 99, No. 7/08, Jul. 1, 2007, pp. 41-44 (XP001542834).

Schaefers et al., "International standards for train communication", Vehicular Tech. Cf. Proceedings, May 15-18, 2000, pp. 1581-1585 (XP000968137).

* cited by examiner

COMPUTERIZED ON-BOARD SYSTEM FOR CONTROLLING A TRAIN

Priority is claimed to French Patent Application No. 08 53909 filed on Jun. 12, 2008, the entire disclosure of which is hereby incorporated by reference herein.

The present invention provides a computerized on-board system for controlling a train or rail vehicle.

BACKGROUND OF THE INVENTION

Currently, trains or rail vehicles which are formed by a succession of carriages, which may or may not be motorized, or wagons have a computerized on-board train control system comprising one or more main processors which are connected to a man/machine interface which is arranged in the cabin via a data transfer network to which there are connected a given number of items of equipment of the vehicle, either directly to this network or via input/output modules.

The man/machine interface is formed, for example, by a computer screen and a keypad which allows the driver to be provided with data and allows instructions to be received from the driver.

Conventionally, the main processor manages the driving and the monitoring of the train or the rail vehicle.

The train or rail vehicle comprises a given number of other items of equipment which may or may not be connected to the main transfer network, such as sound equipment, video cameras, equipment for automatically controlling the train, in particular its speed.

All these items of equipment require a dedicated man/machine interface which is remote in the cabin in order to allow them to be controlled by the driver and the driver to be provided with data.

These man/machine interfaces are each formed by a screen which may be relatively large or small, or display units which are advanced to a greater or lesser extent. These various screens and display units allow data to be provided simultaneously to the driver, but take up a significant amount of space in the driver's cabin and impair the clarity of the data displayed.

SUMMARY OF THE INVENTION

An object of the invention is to provide a computerized on-board system which allows a better arrangement of the cabin for the provision of the data from the various items of equipment of the train or rail vehicle.

The present invention provides a computerized on-board train control system including a train control and monitoring system (TCMS) having a main processor unit (MPU) for controlling the train and electronic control, command and monitoring equipment which is capable of providing control data for the train. The on-board train control system also includes remote input/output modules which are capable of relaying data to and from the main processor unit (MPU) for the outputs/inputs of the train or for the electronic control, command and monitoring equipment which is connected to sub-networks for data transfer, at least one display unit which is capable of making available the control data of the train provided by the main processor unit (MPU) and/or by the electronic control, command and monitoring equipment, and a main data transfer network to which there are connected the main processor unit (MPU), the at least one display unit, the remote input/output modules and the electronic control, command and monitoring items of equipment which are capable of producing specific data for the control of the train and which are connected to the main data transfer network directly or by means of remote input/output modules. The electronic control, command and monitoring equipment which is capable of producing specific control data for the train includes at least one additional item of equipment including electronic equipment for automatic train control (ATC) and/or video surveillance equipment (CCTV). The display unit is capable of processing the data and displaying, in addition to the data provided by the main processor and the electronic control, command and monitoring equipment, data produced by one of the additional items of equipment.

According to preferred specific embodiments, the computerized on-board system may include one or more of the following features:

- an electronic control, command and monitoring equipment which is capable of transmitting specific data directly to the display unit, without passing via the main processor, and the display unit is capable of displaying, in addition to the data provided by the main processor, data produced and transmitted directly to the display unit by the electronic control, command and monitoring equipment without these data being transmitted from the main processor,
- the data transmitted by the electronic control, command and monitoring equipment may not to be transmitted to the main processor,
- means for transferring the data transmitted from the electronic control, command and monitoring equipment to the display unit via the main data transfer network,
- the display unit may include means for connecting directly to the electronic control, command and monitoring equipment for the transmission of data transmitted from the electronic control, command and monitoring equipment to the display unit without passing via the main data transfer network,
- the display unit may include means for selecting the data to be displayed from the data from the main processor and the electronic control, command and monitoring equipment,
- the electronic control, command and monitoring equipment may include at least one of the items of equipment selected from the group including:
  - electronic door control equipment (DCU),
  - electronic equipment for controlling heating/ventilation/air-conditioning (HVAC),
  - electronic fire detection equipment,
  - electronic propulsion control equipment (PCE) which is capable of controlling and adjusting the electric motors which allow the traction of the vehicle,
  - electronic equipment for automatic train control (ATC),
  - sound and data provision equipment,
  - radio communication equipment which allows communication between the driver and persons or equipment on the ground,
  - video surveillance equipment (CCTV),
  - auxiliary electronic energy conversion equipment (ACE),
  - electronic equipment for recording events and incidents, more commonly known as black boxes (BBox), and
  - electronic brake control equipment (BCE),
- the display unit may include means for automatically selecting the data provided in accordance with the data received from the electronic equipment and the main processor, and the display unit may include means for identifying a zone in which an alarm is activated and means for automatically providing images of the zone in which an alarm is activated.

BRIEF DESCRIPTION OF THE DRAWINGS

The present invention will be better understood from a reading of the following description, given purely by way of example and with reference to the drawings, in which.

DETAILED DESCRIPTION

Figure 1:
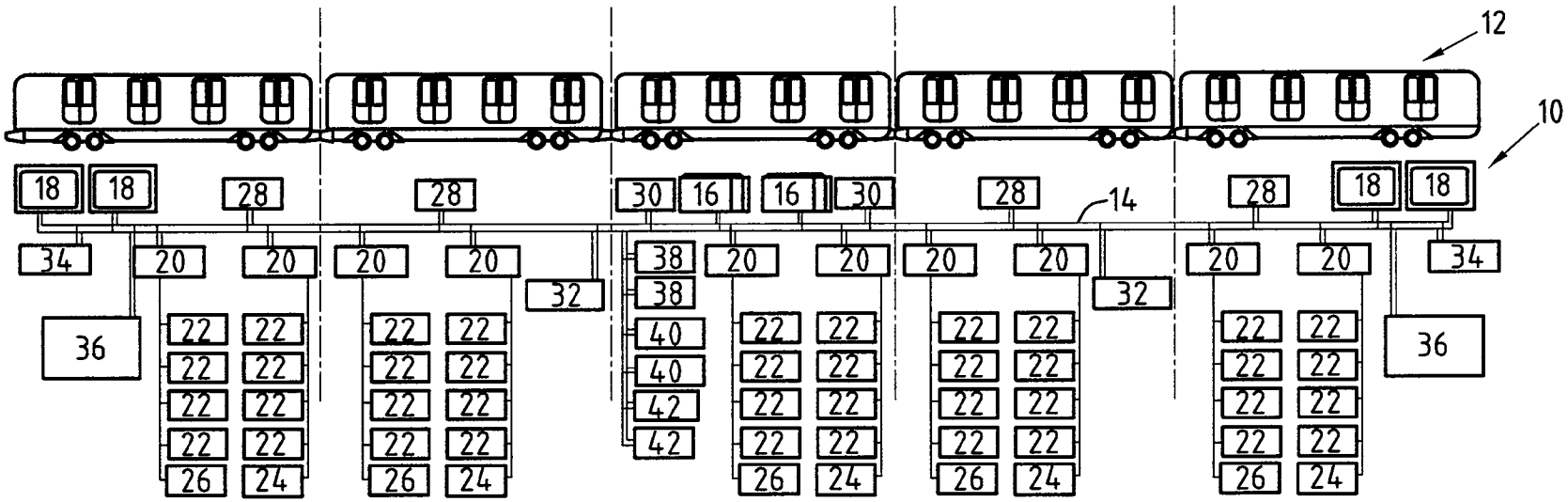
FIG. 1 is a schematic view of the computerized on-board system according to the invention.

The computerized on-board control system 10 illustrated in FIG. 1 is that of a train or rail vehicle 12 including, for example, five successive carriages. This computerized on-board system extends over all the carriages and includes a main data transfer network 14 which connects all the equipment of the computerized on-board system. This communications network is, for example, in accordance with standard IEC 61375-1 and is generally referred to as MVB.

Two redundant main processors 16 are connected to the network 14. These processors ensure the implementation of the computer applications for control of the train which allow the functionalities of the train to be carried out, either by means of direct action of one of the main processors or by delegating a functionality to another item of equipment present on the train which performs the specific function which is dedicated to it. The functionalities carried out for a train may include, for example:

Start-up and preparation of the train;

Traction and braking of the train;

Driving in different modes of the train: automatic, with or without driver, manual, with or without speed limitation (restriction) mode, as a single unit or as a multiple unit (by coupling of trains), etcetera;

Functions referred to as "passenger comfort" functions, such as doors, air-conditioning/heating systems, fire-detection systems, alarm systems, camera surveillance systems, passenger information systems: megaphone system/intercommunication, information (audio and visual) relating to the itinerary, etc.;

Recording of events and incidents during the life of the train (by black box or other equipment dedicated to the function); and Preparing and disembarking from the train.

For information, these applications are written in a language in accordance with the standard IEC 1131.

Furthermore, at each end of the rail vehicle, there are installed in the driver's cabins two display units 18 which allow data provided by the main processors 16 to be made available. In this manner, these display units include an interface for connection to the network MVB 14.

The computerized on-board control system 10 includes remote input/output modules 20 which are connected to the network 14. To these input/output modules there are connected various items of electrical equipment which allow the operation of the train or rail vehicle.

These remote input/output modules 20 include an interface for connection to the MVB network 14 which allows the main processors 16 to acquire data relating to the status of the train (directly via the inputs or via the connection channels of the sub-networks for data transfer) and the commands to be transmitted (directly via the outputs or via the connection channels of the sub-networks for data transfer) to the respective equipment in order to perform a specific function.

As known per se, these input/output modules also act as a gateway between the main network MVB and the sub-networks for data transfer of the type RS232, RS485, CAN, to which there are connected the processors of various items of electrical equipment which allow the operation of the train. This equipment includes the electronic control, command and monitoring equipment which includes units 22 for controlling and monitoring door closure, units 24 for controlling and monitoring heating means, ventilation means and air-conditioning means of the carriages, and units 26 for fire detection and other items of equipment which are not mentioned since they are non-limiting.

The assembly including the main processors 16, display units 18, remote input/output modules 20 and the transfer network 14 which connects them includes the master system for controlling the train or rail vehicle, known as TCMS (Train Control & Monitoring System).

All the items of equipment of the train which are connected to the train control and monitoring system receive control data therefrom and send status data or instructions to the system.

In order to inform the driver of the operating status of this equipment, data are transmitted to the display units 18, which are capable of providing this data to the driver.

In this manner, all the data exchanges between the equipment and the driver are carried out via the train control and monitoring system (TCMS)

External electronic control equipment with respect to the train control and management system TCMS are also connected thereto via the transfer network 14. In this example, the external electronic equipment includes:

electronic propulsion control equipment (PCE) 28 which is capable of controlling and adjusting the electric motors which allow the traction of the vehicle, electronic automatic train control equipment (ATC) 30, sound and data provision equipment 32, radio communication equipment 34 which allows communication between the driver and persons or equipment on the ground, video surveillance equipment (CCTV) 36, auxiliary electronic energy conversion equipment (ACE) 38, electronic equipment 40 for recording events and incidents, more commonly known as black boxes (BBox) 40, and electronic brake control equipment (BCE) 42. This list is non-limiting.

These are in addition to the other items of external equipment which are connected to the network via the input/output interfaces, the electronic control, command and monitoring equipment, including:

electronic door control equipment (DCU) 22, electronic equipment 24 for controlling heating/ventilation/air-conditioning (HVAC), and electronic fire detection equipment 26. This list is non-limiting.

These items of external electronic equipment are capable of receiving and transmitting data, in particular transmitting status data for the information of the driver.

It is also possible for these items of external equipment to be capable of transmitting data directly to the display units 18 of the train control and monitoring system without passing via the main processors 16.

Preferably, all the data which must be provided to the driver from any one of the items of electronic equipment of the train, whether or not the items of electronic equipment are provided via one of the main processors MPU 16, are transmitted to the two display units 18 provided in the cabin and are provided for the driver alternately and selectively only on these display units. In this manner, the same display units are used to display data from one of the main processors MPU 16 but also data from the external equipment, at least some of these data not being received from one of the main processors MPU 16.

Figure 2:
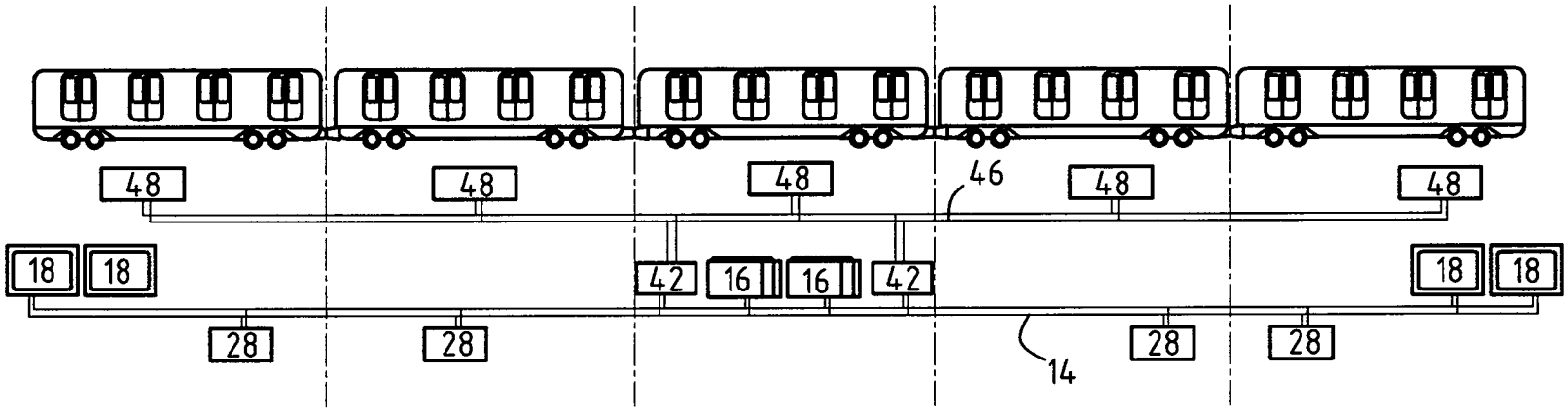
FIG. 2 is a schematic view illustrating the brake control network according to the invention.

FIG. 2 illustrates, for example, external equipment BCE 42 used to control the braking via the computerized on-board system. This external equipment BCE 42 for controlling the braking provides proximity control of the brakes, in particular controls the brake actuators, the measurements of load distribution and emergency braking. The BCE 42 further ensures anti-skid control for the carrier bogies and the co-operation of the electrical and mechanical brakes.

In FIG. 2, the electronic brake control equipment 42 includes an interface which connects it to a sub-network 46 for transferring data, for example, of the CAN type, to the main data transfer network 14. On the sub-network 46, there are arranged panels 48 for controlling local brakes including electronic means for controlling the brakes of each vehicle.

The data relating to the status of the brakes which must be provided to the driver are transmitted from the panels 48 to the display units 18 successively via networks 46 and 14 without passing via and being processed by the main processors MPU 16.

Figure 3:
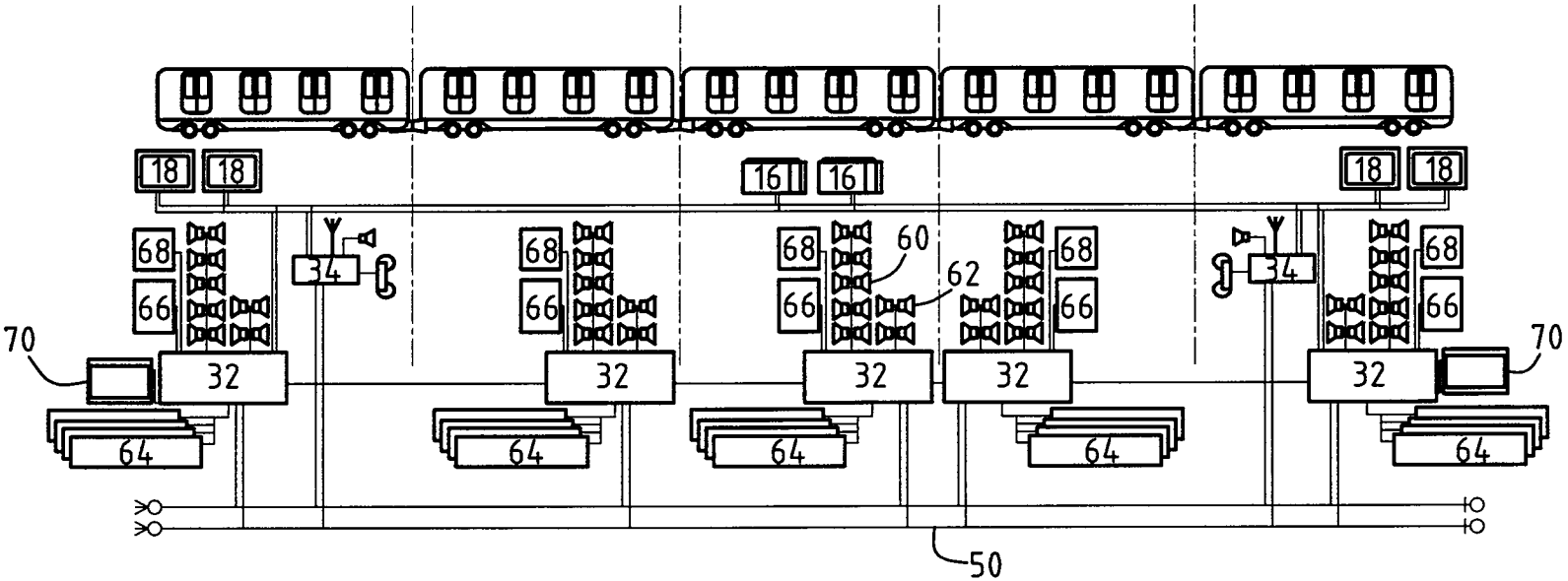
FIG. 3 is a schematic view illustrating the electronic passenger data network according to the invention.

FIG. 3 illustrates sound means and means for providing information for passengers via the on-board computer system. Those means include, as above, an audio data transfer bus 50, to which the sound equipment 32 and the radio communication equipment 34 are connected. The items of equipment 32 and 34 are also connected to the main data transfer network 14, as set out above.

The radio communication equipment 34 is of the TETRA ("TErrestrial Trunked RAdio") type, that is to say, in accordance with the standard ETSI EN 300 392-1 and EN 300 392-2 developed in Europe for digital voice and data radio communication. The radio communication equipment 34 is capable of ensuring the transfer of data and voices between the ground and the train.

The sound and data provision equipment includes an assembly of internal and external loudspeakers 60, 62, display panels 64, equipment 66 for passenger announcements, emergency stop handles 68 for the train, front displays 70 positioned at the ends of the train in order to be visible from outside and indicators for indicating the side at which the doors open.

Figure 4:
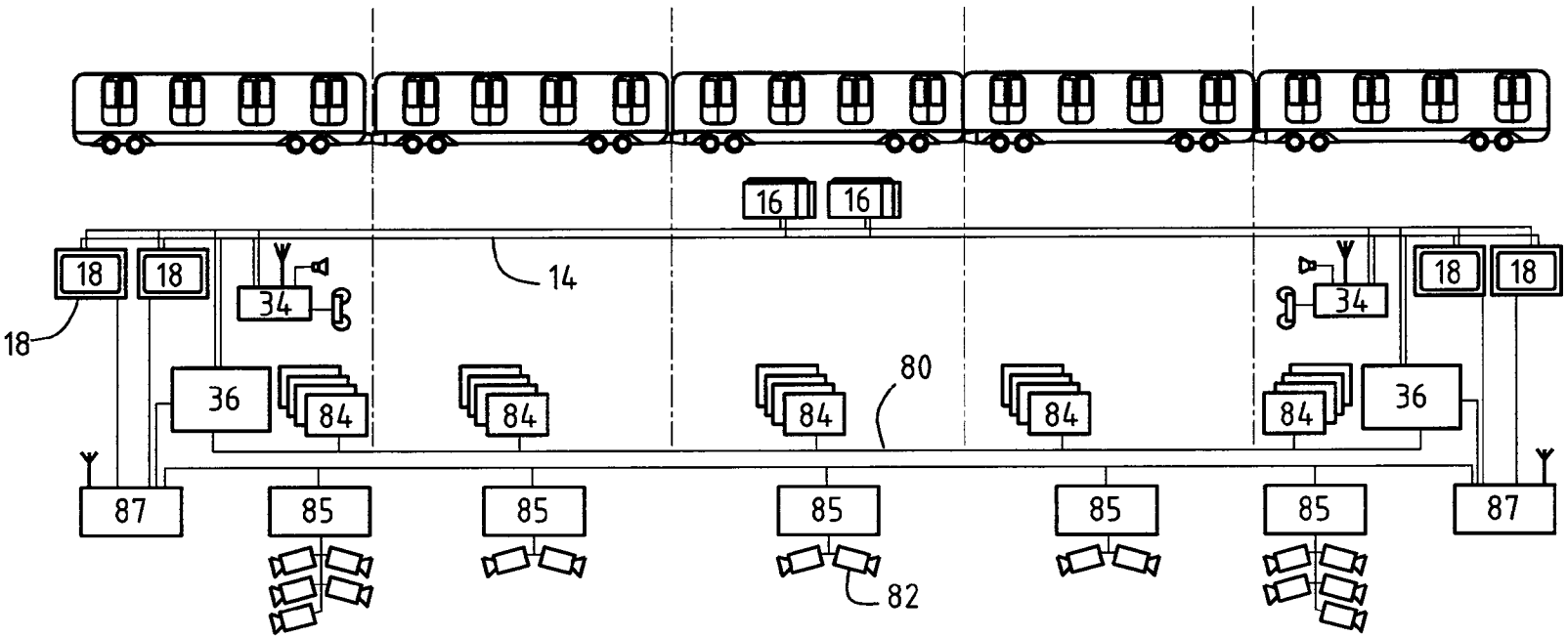
FIG. 4 is a schematic view illustrating the video surveillance network according to the invention.

Furthermore, as illustrated in FIG. 4, the video surveillance equipment (CCTV) 36 includes an image transfer bus 80, to which there are connected video cameras 82 and flat display screens 84. The video surveillance system incorporates video units 85 which are connected to the video bus 80 and to electronic items of equipment 86 for controlling the video system, ensuring the connection thereof to the main bus 14. Those video units 85 are further connected directly to the display units 18 by means of gateways 87.

Figure 5:
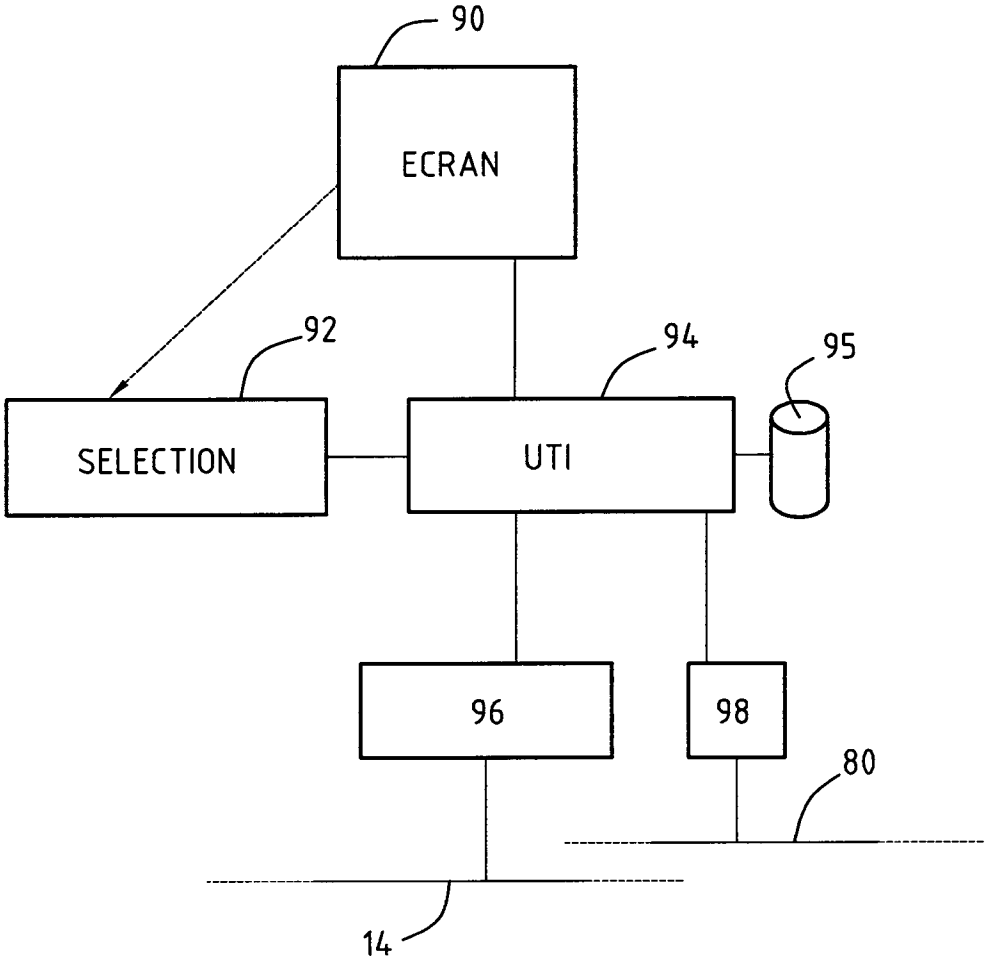
FIG. 5 is a schematic view of a display unit of the computerized on-board system according to the invention.

A display unit DDU 18 is described in greater detail in FIG. 5. The display unit DDU 18 includes a screen 90 (of the touch or button type) which allows information to be displayed. The keypad (of the touch or button type) of the screen forms a means, for example, a user input 92, for entering display requirements by the driver of the train or any other person involved in its maintenance. The screen is connected to a data processing unit 94 which is capable of controlling the display, receiving the data entered and processing the data received from the various items of electronic equipment via the data transfer network 14 by implementing algorithms stored in a memory 95.

In order to receive the data, the display unit 18 includes a first interface 96 for connection to the main data transfer network 14 and a second separate interface 98 for connection to the image transfer bus 80. The interface 98 is capable of receiving images from the video cameras 82.

Preferably, each display unit 18 includes a screen 90 which is connected to a data processing unit 94. There are two redundant and separate display units 18 in each cabin and both are connected to the networks 14 and 80.

The two screens which are associated with the data processing unit thereof function in the same manner and are capable of functioning simultaneously. In the event of a breakdown of one of the two screens or one of the two data processing units, the other remains active allowing the train to operate in a degraded mode.

The display units function under the command of the data processing units implementing the algorithms contained in the memory 95. In particular the data processing units control the display instructions provided from the input means 92 by the driver and, in accordance with those display instructions and the data received via the different networks, display information in accordance with a predetermined presentation. In particular, an algorithm is capable of, from a welcome page, selecting a given number of different display modes, in which data of different kinds are provided to the driver.

Figure 6:
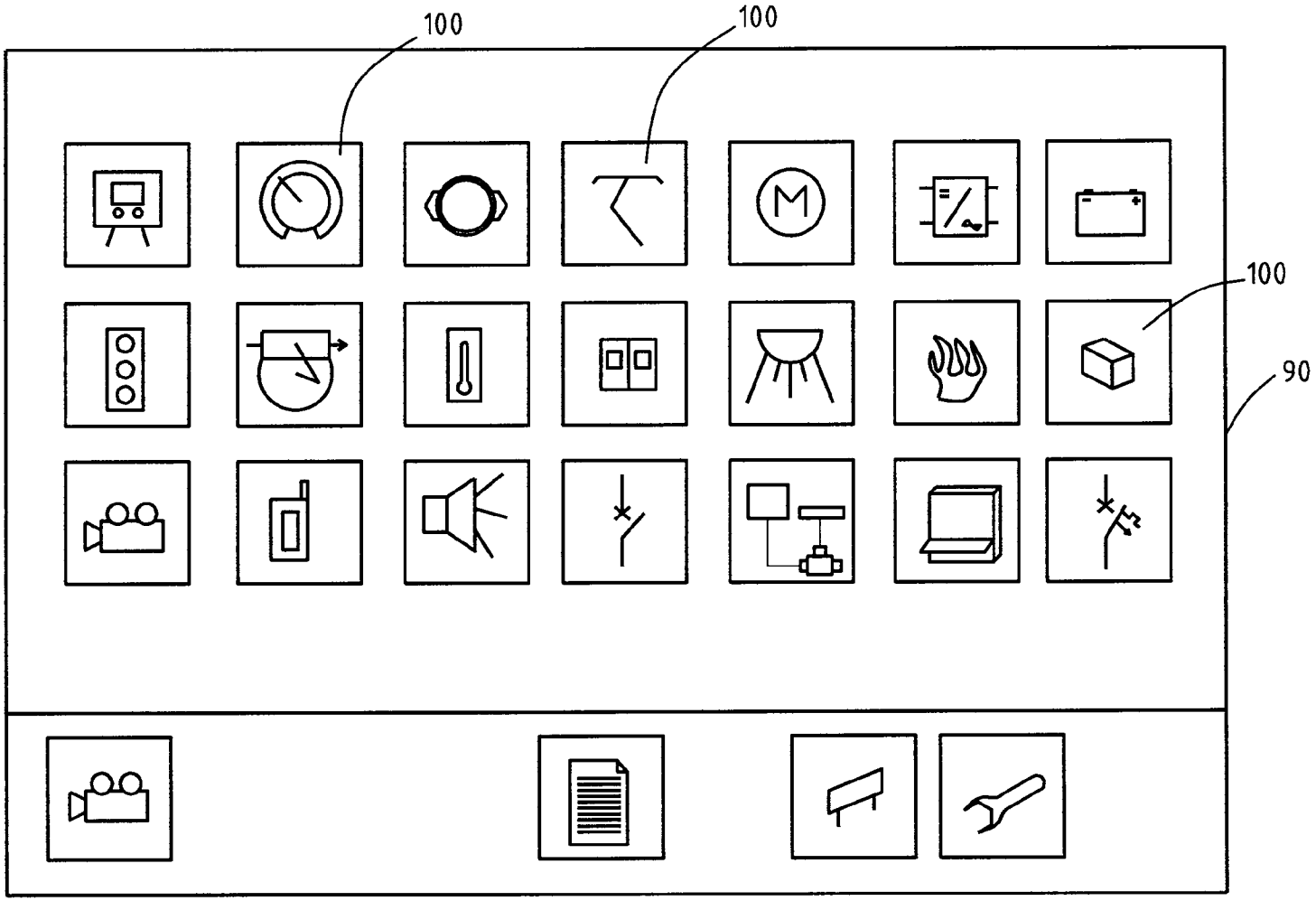
FIGS. 6, 7, 8 and 9 are views of a display unit of the computerized on-board system in different operating modes.

FIG. 6 illustrates the appearance of the screen 90 when the screen 90 displays the welcome page which includes a given number of icons 100, each icon corresponding to an information display option and a display mode.

Some icons afford access to information provided by the main processors 16, other icons allow acquisition of information provided by external electronic control equipment, while other icons allow acquisition of a synthesis of information from the main processors and the external electronic control equipment.

In this example, twenty one icons (non-limiting) are available and allow access to twenty one separate display modes (non-limiting).

The algorithm implemented by the display unit is such that, when an icon is selected by the input means 92, it brings about the display of the information corresponding to the manually selected icon.

Figure 7:
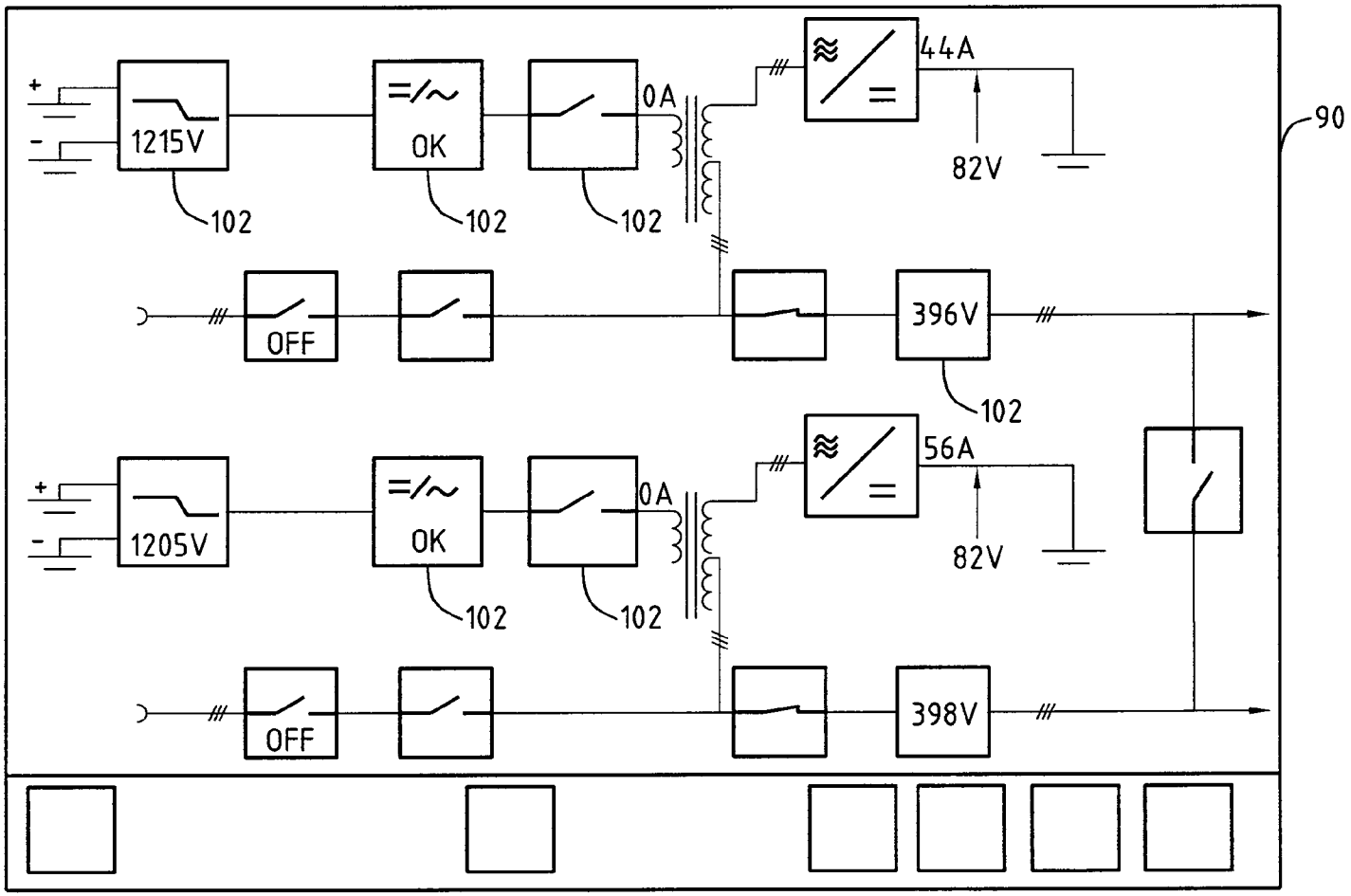

FIG. 7 illustrates a first example of a display screen showing data relating to the operating state of the auxiliary energy conversion equipment of the train. This data is provided by the main processors 16 and is displayed in the manner illustrated on the basis of the algorithm implemented by the data processing unit 94 of the display unit. In this manner, a synoptic diagram of the circuit showing the main elements 102 is displayed on the screen and the voltages and/or strengths of the circulating current and the states of the different elements are directly displayed on the screen opposite the relevant element.

The lower portion of the screen shows icons which allow switching to another display mode, or to the welcome screen.

Figure 8:
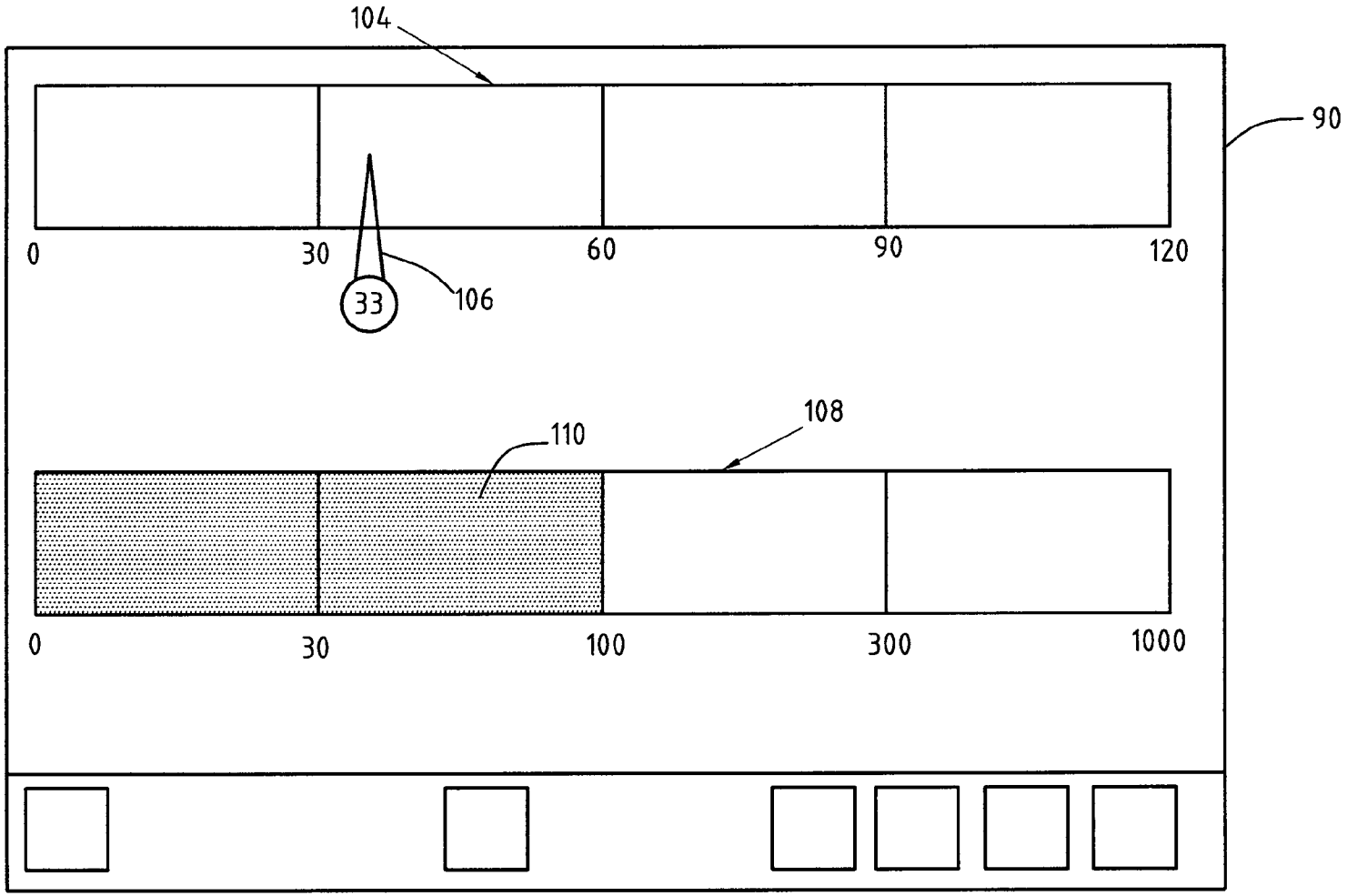

FIG. 8 illustrates the display when a display mode is selected allowing data from the electronic automatic train control equipment (ATC) 30 to be monitored. In this manner, this screen includes a first scale 104 with a moving cursor 106 illustrating the speed of the train and a second scale 108 graphically illustrating, by means of a colored zone 110, the projected distance for stopping the train, taking its current speed into consideration.

All the data displayed on the screen are provided by the electronic automatic train control equipment 30 without those data passing via or being processed by the main processors 16.

The data processing unit 94 of the display unit integrates algorithms for representing and formatting the data obtained directly from the equipment 30.

Figure 9:
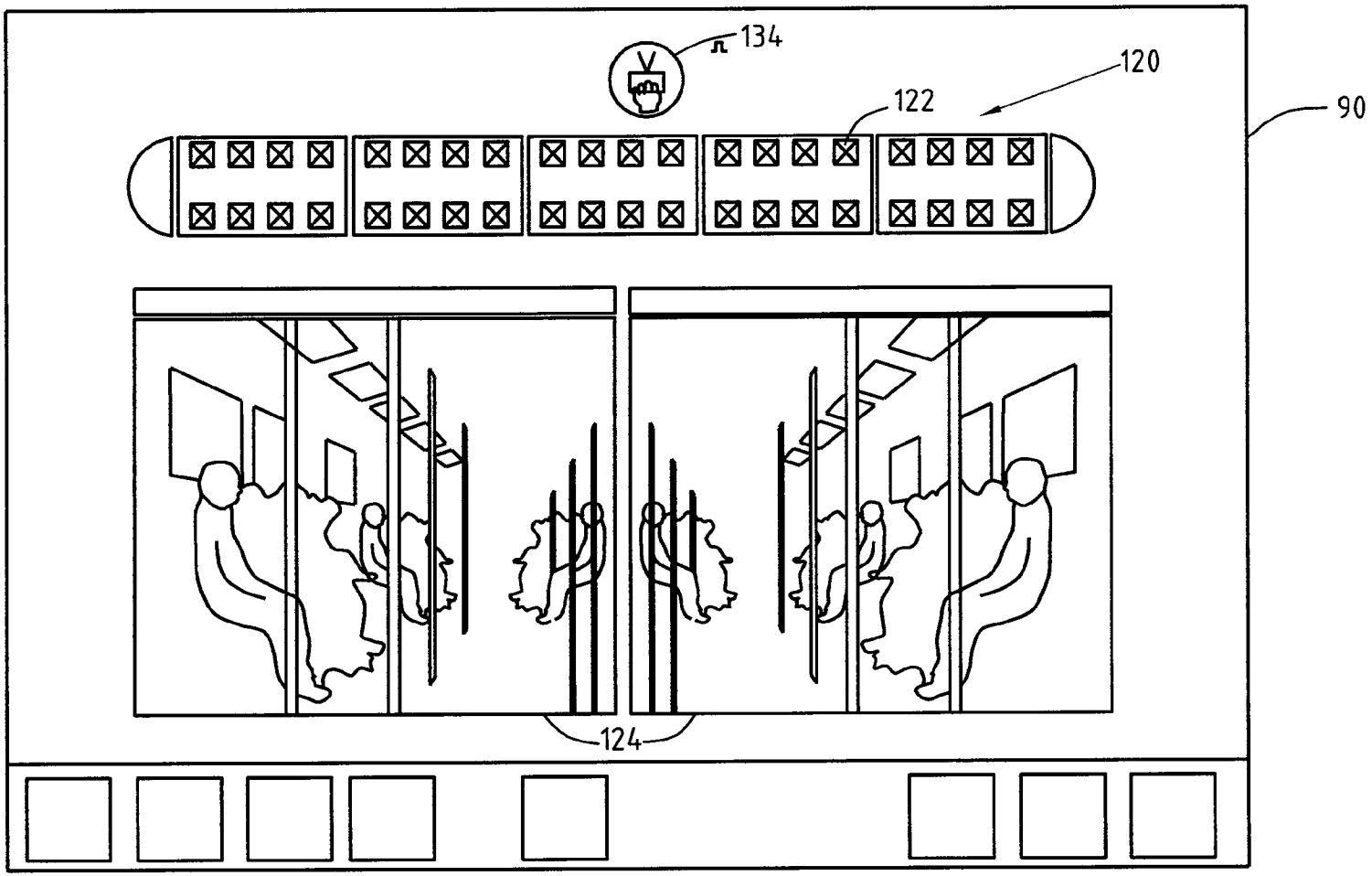

FIG. 9 illustrates a display mode allowing the provision of data from both the main processors and the external electronic equipment.

The upper portion of the screen includes a schematic representation 120 of the train, in which there are illustrated the five carriages and the positions 122 of the doors provided on the train.

The lower portion of the image includes two video sequences 124 which are provided by two cameras of the train. The cameras from which the images originate are selected automatically by the display unit when an alarm is activated following actuation of an emergency stop handle of the train. In that case, the images provided by the cameras which monitor the zone in which the alarm was activated are displayed.

Figure 10:
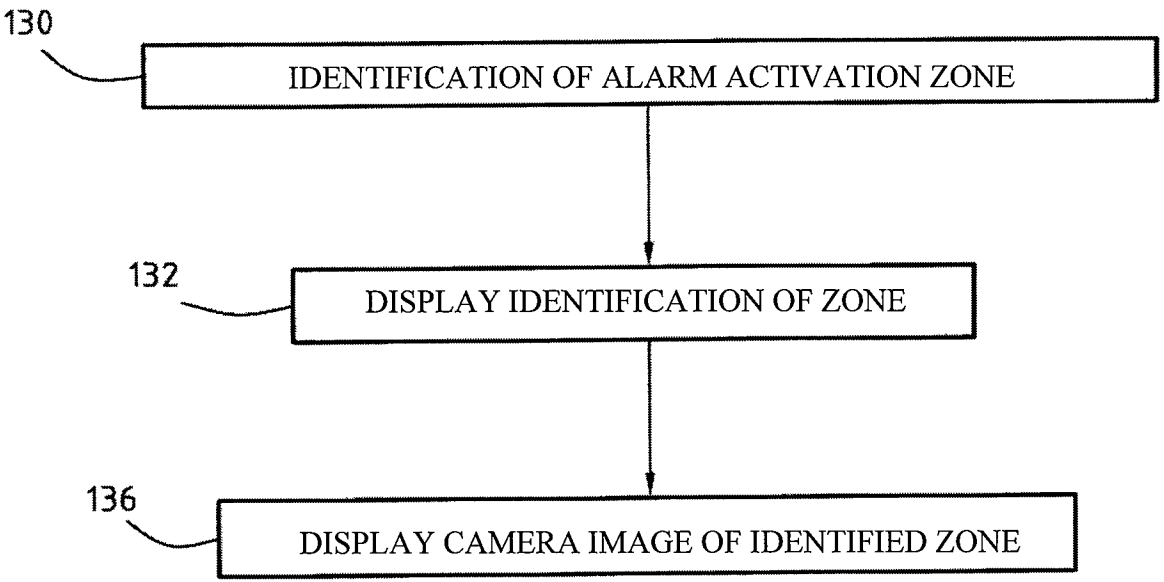
FIG. 10 is a flow chart of an algorithm implemented by the display unit of the computerized on-board system according to the invention.

The data processing unit 94 of the display unit implements, when an alarm is activated by actuation of an emergency stop handle, the algorithm illustrated in FIG. 10. At step 130, the zone in which the stop handle is located is detected. At step 132, this zone is identified on the diagram of the train by a pictogram 134 being positioned opposite that zone. At step 136, the images provided by the two cameras positioned in the alarm activation zone detected are displayed on the two lower regions of the screen.

In this manner, the algorithm allows automatic display, without any intervention by the driver, of video images showing the activation zone of the alarm.

It will be appreciated that such an algorithm allows the driver to be provided with the most relevant data, at any given moment, while considerably reducing the number of screens to be fitted in the driver's cabin. The same mechanism is carried out for other types of data.

Using the same control unit, including a unit for processing the data by means of algorithms for providing data from different origins, whether they are processed by the train control and monitoring system or not, allows improvements to the arrangement of the cabin and intelligence to be applied to the processing of the data to be displayed in place of a simple display unit having no intelligence, and allows the driver to be shown only the data which he really needs, thereby facilitating comprehension of the data available and simultaneously reducing the cost of the cabin by reducing the number of display units necessary (each one specific to a function) and by reducing the resultant spatial requirement of these various display units.

What is claimed is:

1. A computerized on-board system for controlling a train or rail vehicle comprising:

a train control and monitoring system including a main processor unit for controlling the train and electronic control, command and monitoring equipment for providing control data for the train, the control data including data concerning a main function of the train or rail vehicle, the control data including data for start-up and preparation of the train or rail vehicle, traction and braking of the train or rail vehicle or driving the train or rail vehicle in different modes;

remote input/output modules for relaying data to and from the main processor unit for outputs/inputs of the train or for the electronic control, command and monitoring equipment which is connected to sub-networks for data transfer;

at least one display unit for displaying the control data of the train provided by the main processor unit or by the electronic control, command and monitoring equipment; and a main data transfer network, wherein the main processor unit, the at least one display unit, the remote input/output modules and the electronic control, command and monitoring items of equipment are connected to the main data transfer network directly or indirectly by remote input/output modules, the electronic control, command and monitoring equipment includes at least one additional item of equipment, the at least one additional item of equipment being electronic equipment for automatic train control or video surveillance equipment, wherein the display unit is capable of processing the data and displaying, in addition to the data provided by the main processor and the electronic control, command and monitoring equipment, data produced by one of the at least one additional items of equipment, the data produced by one of the at least one additional items of equipment bypassing the main processor.

2. The computerized on-board system for controlling a train according to claim 1, wherein the electronic control, command and monitoring equipment transmits specific data directly to the display unit, without passing via the main processor, and the display unit displays, in addition to the data provided by the main processor, data produced and transmitted directly to the display unit by the electronic control, command and monitoring equipment without passing via the main processor.

3. The computerized on-board system for controlling a train according to claim 2, wherein the data transmitted by the electronic control, command and monitoring equipment is adapted to transmit certain data directly to the display unit and not to transmit such data to the main processor.

4. The computerized on-board system for controlling a train according to claim 2, wherein the data transmitted from the electronic control, command and monitoring equipment to the display unit is transmitted via the main data transfer network.

5. The computerized on-board system for controlling a train according to claim 2, wherein the display unit is connected directly to the electronic control, command and monitoring equipment for the transmission of data transmitted from the electronic control, command and monitoring equipment to the display unit without passing via the main data transfer network.

6. The computerized on-board system for controlling a train according to claim 2, wherein the display unit includes an input device for selecting the data to be displayed from the data from the main processor and the electronic control, command and monitoring equipment.

7. The computerized on-board system for controlling a train according to claim 6, wherein the input device includes a keyboard.

8. The computerized on-board system for controlling a train according to claim 2, wherein the electronic control, command and monitoring equipment includes at least one item of equipment selected from the group comprising:

electronic door control equipment electronic equipment for controlling heating/ventilation/air-conditioning, electronic fire detection equipment, electronic propulsion control equipment for controlling and adjusting electric motors to set traction of the vehicle, electronic equipment for automatic control of the train, sound and data provision equipment, radio communication equipment for communication between a driver and persons or equipment on the ground, video surveillance equipment, auxiliary electronic energy conversion equipment, electronic equipment for recording events and incidents, and electronic brake control equipment.

9. The computerized on-board system for controlling a train according to claim 8, wherein the electronic equipment for recording events and incidents is a black box.

10. The computerized on-board system for controlling a train according to claim 1, wherein the display unit automatically selects the data to be displayed provided in accordance with the data received from the electronic equipment and the main processor.

11. The computerized on-board system for controlling a train according to claim 10, wherein the display unit identifies a zone in which an alarm is activated and automatically provides images of the zone in which the alarm is activated.

12. The computerized on-board system for controlling a train according to claim 1, wherein the display unit includes a data processing unit that automatically selects the data to be displayed provided in accordance with the data received from the electronic equipment and the main processor.

13. The computerized on-board system for controlling a train according to claim 12, wherein the data processing unit identifies a zone in which an alarm is activated and automatically provides images of the zone in which the alarm is activated.

14. The computerized on-board system for controlling a train according to claim 1 wherein the main function is movement of the train or rail vehicle.

15. A computerized on-board system for controlling a train or rail vehicle comprising:

a train control and monitoring system including a main processor unit, at least one display unit, remote input/output modules and a main data transfer network, the main processor unit controlling the driving and movement of the train and providing control data related thereto, the remote input/output modules relaying the control data to and from the main processor unit via the main data transfer network to at least one display unit; and electronic control, command and monitoring equipment providing further data for the train, the further data being relayed to the at least one display via remote input/output modules, directly via the main network, indirectly via sub-networks or directly to the at least one display, the electronic control, command and monitoring equipment including at least one additional item of equipment for automatic train control or video surveillance, the at least one display unit displaying the control data of the train provided by the main processor unit, the further data provided by the electronic control, command and monitoring equipment and the additional data provided by the at least one additional item of equipment, the additional data bypassing the main processor.

16. The computerized on-board system for controlling a train or rail vehicle according to claim 15 wherein the control data includes data concerning start-up and preparation of the train, traction and braking of the train and different driving modes.

* * * * *